United States Patent [19]

Moore

[11] Patent Number: 4,773,836

[45] **Date of Patent: * Sep. 27, 1988**

[54] ROTARY VANE PUMP

[75] Inventor: Jesse C. Moore, Celina, Ohio

[73] Assignee: J. C. Moore Research Inc., Celina, Ohio

[ * ] Notice: The portion of the term of this patent subsequent to Jun. 16, 2004 has been disclaimed.

[21] Appl. No.: 62,776

[22] Filed: Jun. 15, 1987

Related U.S. Application Data

[63] Continuation-in-part of Ser. No. 822,374, Jan. 27, 1986, Pat. No. 4,673,343, which is a continuation-in-part of Ser. No. 600,281, Apr. 13, 1984, Pat. No. 4,568,257.

[51] Int. Cl.[4] ..... F04C 18/46; F04C 29/02

[52] U.S. Cl. ..... 418/98; 418/100; 418/173; 418/185; 418/187; 418/DIG. 1

[58] Field of Search ..... 418/88, 94, 97–100, 418/173, 185, 187, 188, DIG. 1

[56] References Cited

U.S. PATENT DOCUMENTS

| | | | |
|---|---|---|---|
| 917,944 | 4/1909 | Hoffman | 418/173 |
| 983,754 | 2/1911 | Nichols | 418/184 |
| 1,352,107 | 9/1920 | Wagenhorst | 418/185 |
| 1,364,246 | 1/1921 | Carrey | 418/98 |
| 1,390,932 | 9/1921 | Shiner | 418/173 |
| 1,719,954 | 7/1929 | Wilson | 418/185 |
| 1,851,193 | 3/1932 | Laraque | 418/173 |
| 1,941,651 | 1/1934 | Behlmer | 418/185 |
| 2,102,346 | 12/1937 | Wishart | 418/173 |
| 2,246,274 | 6/1941 | Davidson | 418/173 |
| 2,316,318 | 4/1943 | Davidson | 418/188 |
| 2,891,482 | 6/1959 | Menon | 418/173 |
| 2,969,743 | 1/1961 | Menon | 418/173 |
| 3,102,683 | 9/1963 | Paschke et al. | 418/94 |
| 3,298,331 | 1/1967 | Butler | 418/187 |
| 3,360,192 | 12/1967 | Van Hees | 418/88 |
| 3,697,203 | 10/1972 | Butler | 418/173 |
| 4,003,682 | 1/1977 | Stein | 418/173 |
| 4,673,343 | 6/1987 | Moore | 418/173 |

FOREIGN PATENT DOCUMENTS

| | | | |
|---|---|---|---|
| 107899 | 11/1927 | Austria | 418/94 |
| 1231263 | 5/1986 | U.S.S.R. | 418/94 |

*Primary Examiner*—John J. Vrablik

*Attorney, Agent, or Firm*—Jacox & Meckstroth

[57] ABSTRACT

A rotary vane pump comprising an inner rotor and an outer rotor which rotate together about eccentric axes. A pair of support shafts is attached to the inner rotor and are rotatably mounted for rotation of the inner rotor. At least one of the support shafts is hollow and serves as a fluid conduit. The outer rotor and the inner rotor are provided with ports at the ends thereof for flow of fluid into the inner rotor. The relative dimensions of the rotors are such that a chamber is formed between the rotors. A vane is attached to the outer rotor and slidably extends into a slot in the inner rotor. The vane divides the chamber into intake and outlet portions. Fluid flows from the inner rotor into the chamber between the rotors, and fluid flows from the chamber into a fluid conduit formed by the hollow support shaft. The rotary vane pump is adapted to pump fluids, such as gases and liquids, separately or in combination. The rotary vane pump includes structure for introducing and circulating a lubricant within the pump.

21 Claims, 5 Drawing Sheets

5
4
112
100
108
124
114
44
120
110
48
89
88
87
86
124
58
120
38
54
40
66
70
98
68
70a
56
120
52
124
87
86
63
61
28
24
60
76
160
32
20
30

158
144
150
154
152
148
100
92
93
83
88
91
90
80
140
60
95
94
84
87
97
96
70a
70
68
87
87
63
76
160

158
144
150
154
152
148
100
83
92
83
89
91
93
90
80
140
60
95
84
87
98
70
68
87
66
87
63
160
76

ROTARY VANE PUMP

RELATED APPLICATION

This application is a continuation-in-part of patent application Ser. No. 822,374, filed Jan. 27, 1986, now U.S. Pat. No. 4,673,343, which is a continuation-in-part of patent application Ser. No. 600,281, filed Apr. 13, 1984, now U.S. Pat. No. 4,568,257.

BACKGROUND OF THE INVENTION

Numerous rotary vane pumps have been devised for pumping fluid. However, most of the known rotary vane pumps have been found to be relatively inefficient in operation and complex in structure. Known rotary vane pumps also are subject to excessive wear of the moving parts. Known rotary vane pumps do not have good seal characteristics between moving parts.

It is therefore an object of this invention to provide a rotary vane pump which is efficient in operation, and which does not have parts which wear excessively.

It is another object of this invention to provide such a rotary vane pump in which "back-flow" does not occur.

Another object of this invention is to provide such a rotary vane pump in which the bearings are readily accessible for inspection.

It is another object of this invention to provide such a rotary vane pump which can be produced and operated at relatively low costs.

It is another object of this invention to provide a rotary vane pump which is capable of pumping a gaseous material and which also includes means for introduction of a lubricant into the pump for lubrication, for sealing and for cooling the pump.

It is another object of this invention to provide such a rotary vane pump which includes means for controlling circulation of the lubricant through the pump.

Other objects and advantages of this invention reside in the construction of parts, the combination thereof, tee method of production and the mode of operation, as will become more apparent from the following description.

SUMMARY OF THE INVENTION

This invention comprises a rotary pump for pumping fluids, hydraulic and/or gas. The rotary pump comprises an inner rotor and an outer rotor which rotate together about eccentric axes. The outer rotor comprises a cylindrical enclosure within which the inner rotor is positioned. A vane is attached to the inner surface of the outer rotor and slidably extends into a slot in the inner rotor. Due to the fact that the inner rotor and the outer rotor rotate about eccentric axes, there is relative reciprocal lateral movement between the inner rotor and the outer rotor during rotation thereof. There is also reciprocal movement between the inner rotor and the vane during rotation of the rotors.

This invention also includes means for introduction of a gas into the pump and for circulation of a lubricant through the pump.

DETAILED DESCRIPTION OF THE PREFERRED EMBODIMENT

Figure 1:
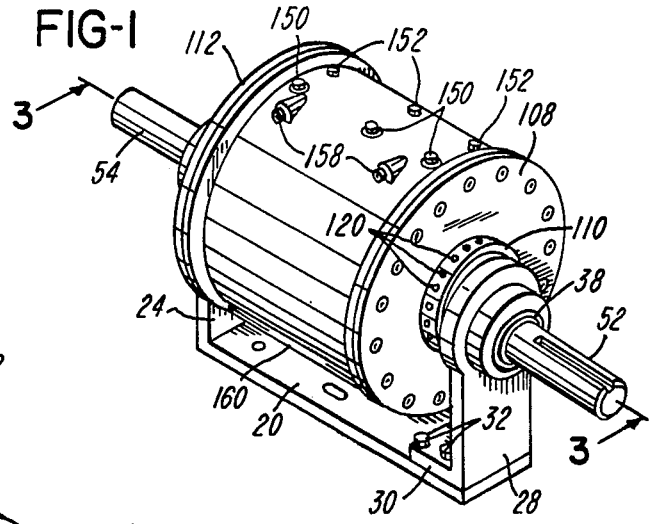
FIG. 1 is a perspective view of a rotary vane pump of this invention.

A rotary vane pump of this invention comprises a base 20, shown herein as being horizontal. The base 20 has a pedestal 24 at one end thereof and a pedestal 28 at the other end thereof. The pedestal 28 is shown as being attached to the base 20 by means of a plate 30 and bolts 32.

The pedestal 28 supports a bearing 38, and the pedestal 24 supports a bearing 40. The pedestal 24 also supports a bearing 44, and the pedestal 28 also supports a bearing 48. The bearings 38 and 40 are coaxial, and the bearings 44 and 48 are coaxial. However, the bearing 44 and 48 are not coaxial with the bearings 38 and 40. A shaft 52, shown herein as a solid shaft, extends through the bearing 38 and is rotatably supported thereby. A hollow shaft 54 extends through the bearing 40 and is rotatably supported thereby. The shafts 52 and 54 have flanges 56 and 58, respectively, which are attached to an inner rotor 60 and support the inner rotor 60. The inner rotor 60 has opposed end walls 61 and 63. The flange 56 of the shaft 52 is attached to the end wall 61, and the flange 58 of the shaft 54 is attached to the end wall 63. The flange 58 has openings 66 therein.

Between the flange 56 of the shaft 52 and the flange 58 of the shaft 54, the inner rotor 60 has a shaft, 68 provided with a passage 70. A portion of the passage 70 is show as having an elongate cylindrical wall and a portion of the passage 70 comprises a slot **70*a*** having substantially straight parallel walls.

The inner rotor 60 has a chamber 76 therein. A radially extending wall 80 attaches the shaft 68 to the outer portion of the inner rotor 60. The wall 80 extends substantially the length of the inner rotor 60. Within the wall 80 is a slot 84, shown in FIG. 2, which extends substantially the length of the inner rotor 60. Extending through the end wall 61 and encompassing the flange 56 of the shaft 52 is a plurality of orifices 86, arranged in an annular configuration. Extending through the end wall 63 and encompassing the flange 58 of the shaft 54 is a plurality of orifices 87, arranged in an annular configuration.

Figure 2:
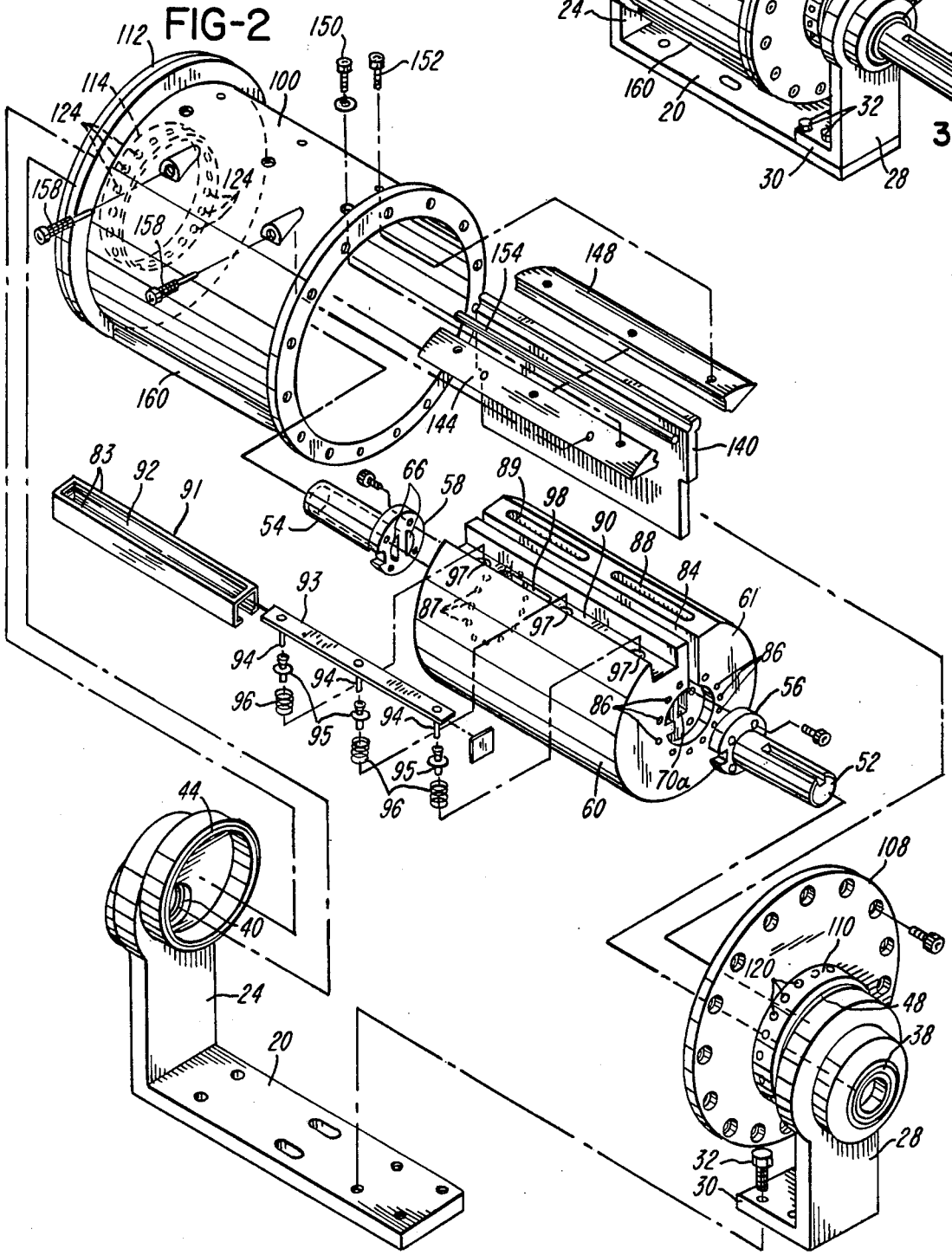
FIG. 2 is an exploded perspective view of the rotary vane pump, drawn on a larger scale than FIG. 1.
Figure 3:
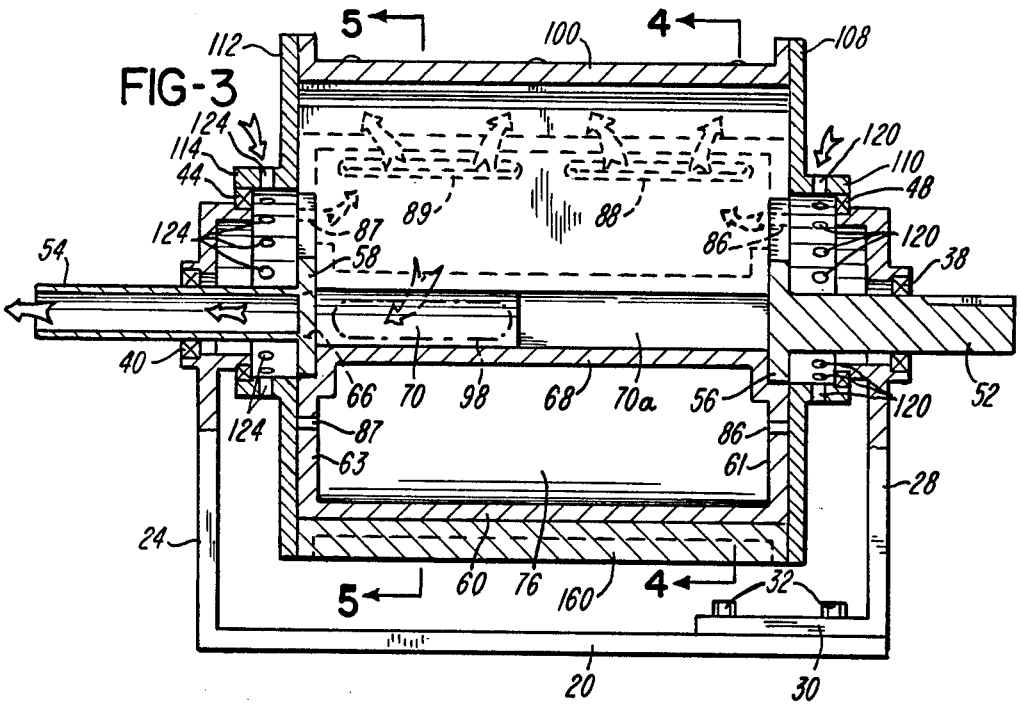
FIG. 3 is a sectional view taken substantially on line 3—3 of FIG. 1 and drawn on a larger scale than FIG. 1.
Figure 4:
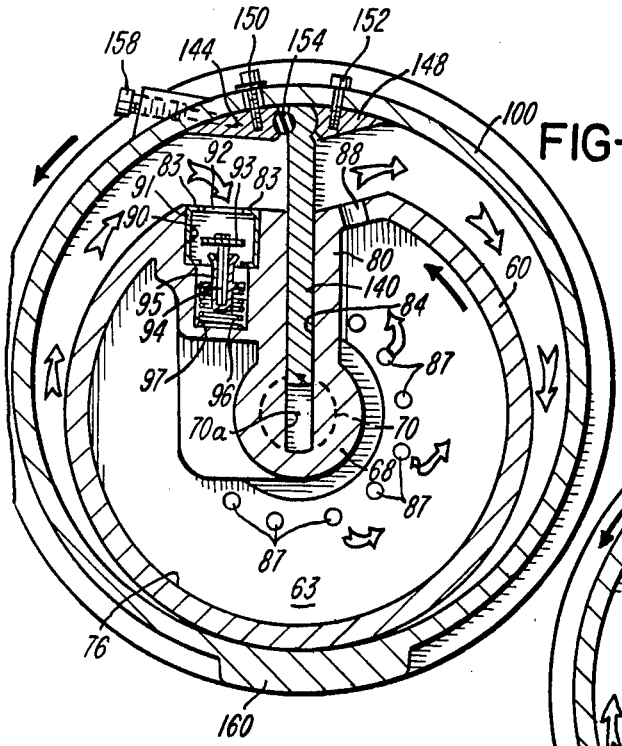
FIG. 4 is a sectional view taken substantially on line 4—4 of FIG. 3.
Figure 5:
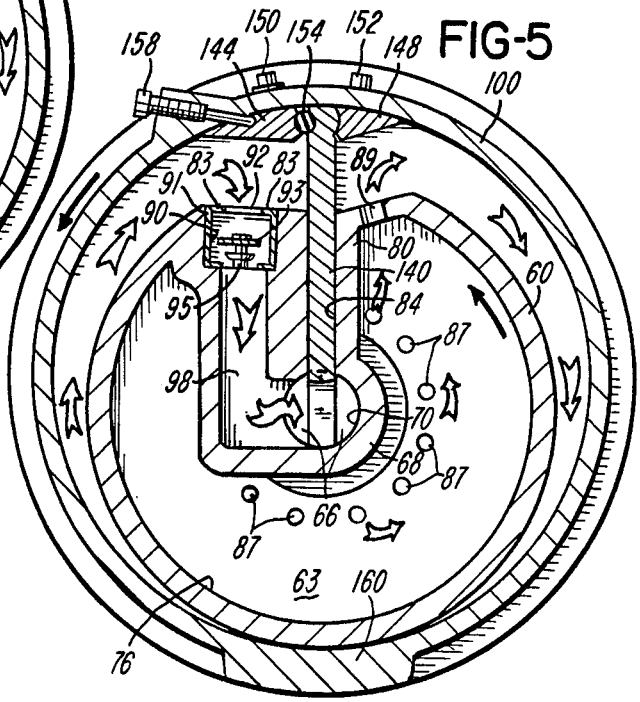
FIG. 5 is a sectional view taken substantially on line 5—5 of FIG. 3.

As shown in FIGS. 2, 4, and 5, the inner rotor 60 has elongate passages 88 and 89, which lead from the periphery of the inner rotor 60 to the chamber 76 therein. The inner rotor 60 has an axially extending peripheral channel 90, within which is an elongate valve member 91 which is secured to the channel 90 of the inner rotor 60. The valve member 91 is provided with a pair of spaced-apart flanges 83 which serve as a valve seat and form an elongate opening 92 in the valve member 91. Mounted within the channel 90 is an elongate movable valve member 93 which has stems 94 attached thereto, as shown in FIG. 2. Sleeve members 95 encompass the stems 94. The sleeve members 95 are urged by spring members 96 toward the flanges 83. The spring members 96 are seated in recesses 97 in the channel 90. Thus, the movable valve member 93 is urged by the spring members 96 toward the elongate opening 92 for closing of the opening 92.

In communication with the channel 90 is a passage 98 which leads to the axially extending passage 70 within the inner rotor 60.

Encompassing the inner rotor 60 is an outer rotor 100. The outer rotor 100 has an end cover 108 at one end thereof which has an annular hub 110 integral therewith. The hub 110 is rotatably supported upon the bearing 48. At the other end of the outer rotor 100 is an end cover 112 provided with a hub 114. The hub 114 is rotatably supported upon the bearing 44. The annular hub 110 is provided with a plurality of apertures 120 therethrough. The annular hub 114 is provided with a plurality of apertures 124 therethrough.

Attached to the inner surface of the outer rotor 100 is a vane 140. The vane 140 is secured to the outer rotor 100 by means of clamping members 144 and 148, which are retained by screws 150 and 152, respectively. A resilient spacer member 154 is positioned between the clamping member 144 and the vane 140 and permits angular movement of the vane 140 with respect to the outer rotor 100. Screws 158 which engage the clamping member 144 serve as adjustment means. The vane 140 extends into the slot 84 of the inner rotor 60. The vane 140 is slidably positioned within the slot 84 of the inner rotor 60.

Attached to the exterior surface of the outer rotor 100 is a counterweight 160.

Operation

Preferably, drive means are attached to the shaft 52 for rotation thereof. Rotation of the shaft causes rotation of the inner rotor 60. Due to the fact that the vane 140 is attached to the outer rotor 100 and extends into the inner rotor 60, rotation of the inner rotor 60 causes rotation of the outer rotor 100. For purposes of description of the operation, the rotors 60 and 100 are shown as rotating in a counter-clockwise direction, as illustrated in FIGS. 4–8.

Due to the fact that the inner rotor 60 and the outer rotor 100 do not rotate upon concentric axes, there is lateral movement between the outer rotor 100 and the inner rotor 60 during rotation thereof Thus, during rotation of the outer rotor 100 and the inner rotor 60 there is relative movement between the vane 140 and the inner rotor 60.

The apparatus of this invention shown herein may be positioned within a space filled with air, or the apparatus of this invention shown herein may be positioned within a space filled with any other fluid, either a liquid or a gas.

As the outer rotor 100 and the inner rotor 60 rotate, fluid flows into the hub 110 through the apertures 120 in the hub 110 and through the apertures 124 in the hub 114. The fluid then flows into the inner rotor 60 through the orifices 86 and 87.

Figure 6:
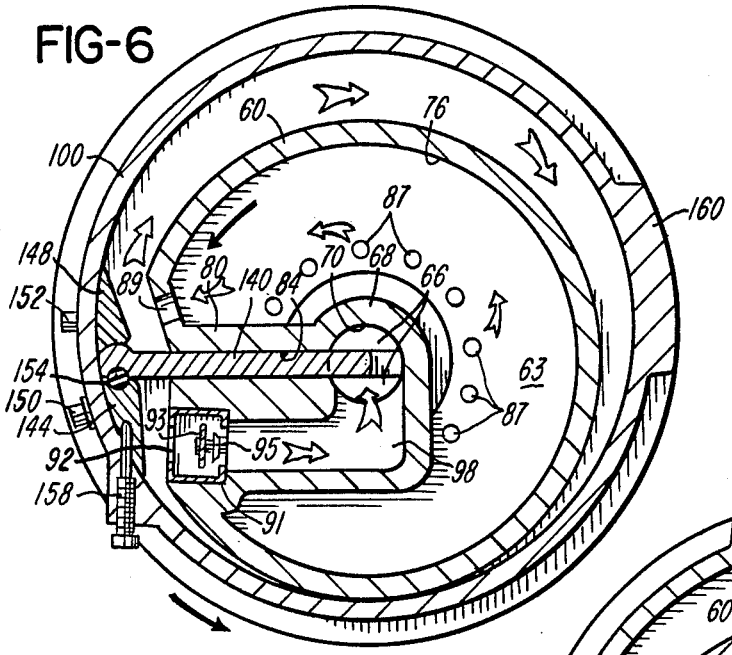
FIG. 6 is a sectional view taken substantially on line 5—5 of FIG. 3 but illustrating the elements of the rotary vane pump in another position of operation.

As illustrated in FIGS. 4 and 5 the fluid flows into the inner rotor 60 through the orifices 87 and then flows outwardly from the inner rotor 60 through the passages 88 and 89. The fluid thus flows from the inner rotor 60 into a chamber or space between the inner rotor 60 and the outer rotor 100. The fluid flows into the chamber or space between the inner rotor 60 and the outer rotor 100 to the right side of the vane 140, as shown in FIGS. 4 and 5. Then as the inner rotor 60 and the outer rotor 100 continue to rotate in a counter-clockwise direction as viewed in FIG. 6, the chamber or space between the inner rotor 60 and the outer rotor 100 on the right side of the vane 140 increases in volume. Thus, the volume of fluid within this space increases, as fluid flows into this space between the inner rotor 60 and the outer rotor 100, as illustrated in FIG. 6.

Figure 7:
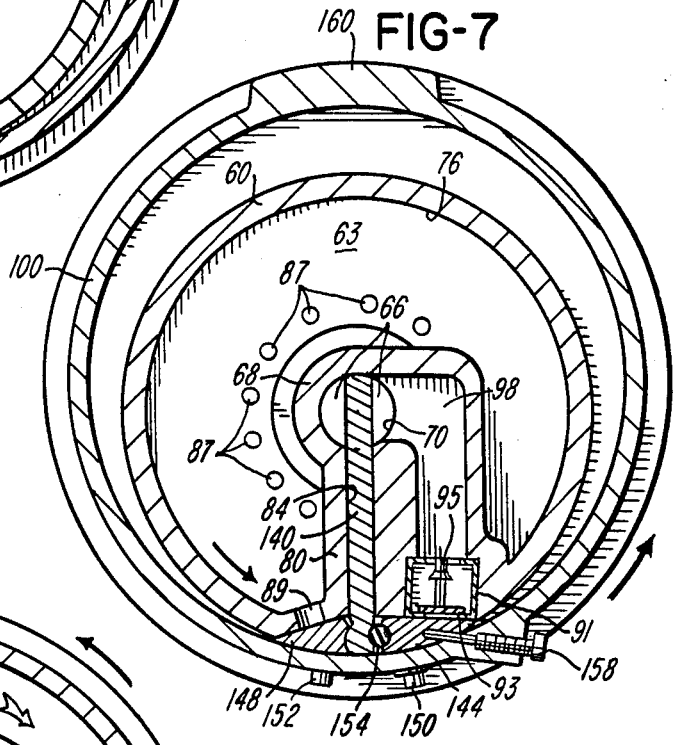
FIG. 7 is a sectional view taken substantially on line 5—5 of FIG. 3 but illustrating the elements of the rotary vane pump in another position of operation.

Then, as the inner rotor 60 and the outer rotor 100 continue to rotate to the position thereof shown in FIG. 7, the space between the inner rotor 60 and the outer rotor 100 is a maximum. At this position of the inner rotor 60 and the outer rotor 100 there is no flow of fluid into the inner rotor 60 and no flow of fluid between the inner rotor 60 and the outer rotor 100.

Figure 8:
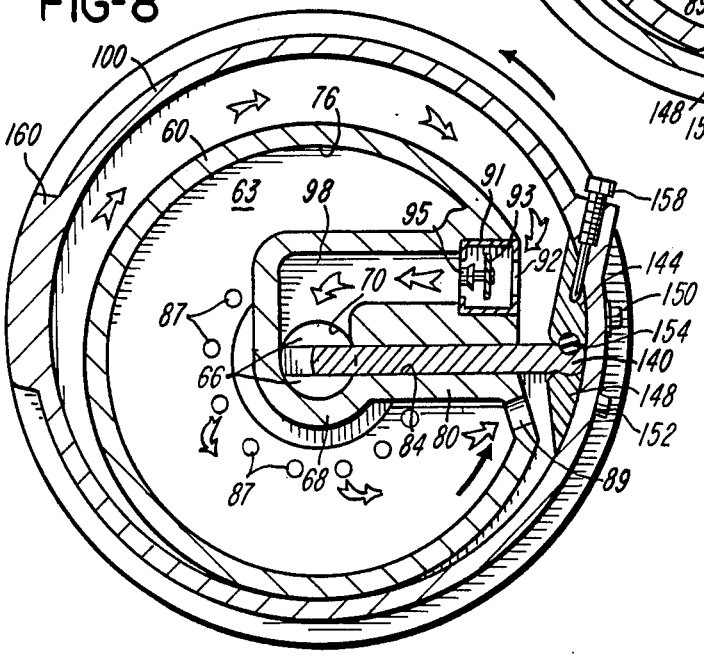
FIG. 8 is a sectional view taken substantially on line 5—5 of FIG. 3 but illustrating the elements in still another position of operation.

Then as the inner rotor 60 and the outer rotor 100 continue to rotate in a counter-clockwise direction as shown in FIG. 8, the space between the inner rotor 60 and the outer rotor 100 to the left of the vane 140 decreases. Thus, the fluid between the inner rotor 60 and the outer rotor 100 to the left of the vane 140 is forced to flow into the passage 98, through the valve member 91. The movable valve member 93 is forced away from the valve seat formed by the flanges 83 in the valve member 91. Thus, fluid flows through the passage 98 into the passage 70, the fluid then flows from the passage 70 into the shaft 54 through the openings 66 in the flange 58. The fluid thus flows outwardly from the shaft 54.

Thus, as the inner rotor 60 and the outer rotor 100 continue to rotate in a counter-clockwise direction, fluid continues to be forced from the openings 66 through the shaft 54, and fluid continues to be drawn into the inner rotor 60 through the openings 120 and 124 in the hubs 110 and 114 and through the orifices 86 and 87. Fluid which flows into the inner rotor 60 through the orifices 86 and 87 flows from the inner rotor 60 into the space between the inner rotor 60 and the outer rotor 100 through the passages 88 and 89, as illustrated in FIGS. 4 and 5.

Figure 9:
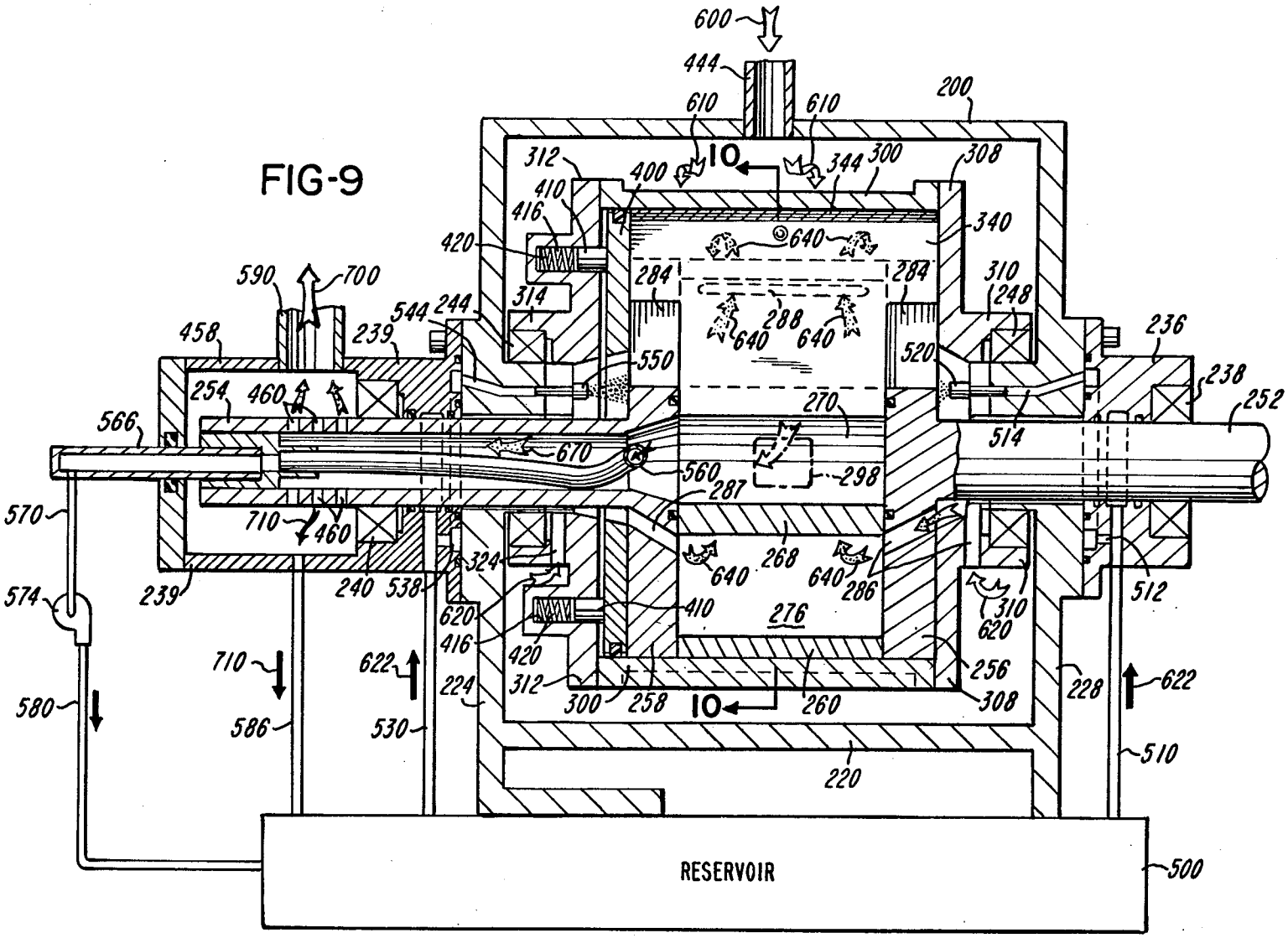
FIG. 9 is a sectional view showing a modification of the rotary vane pump of this invention.
Figure 10:
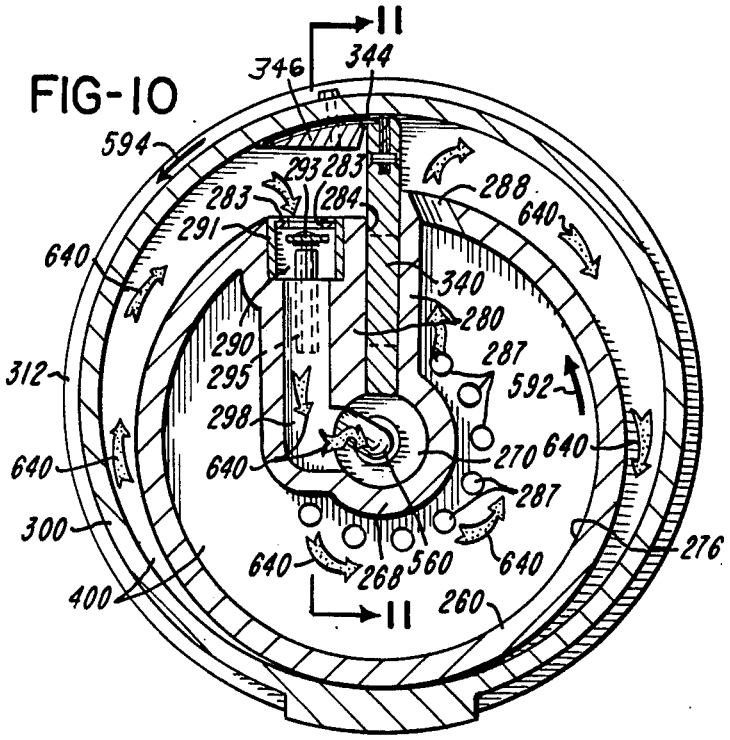
FIG. 10 is a sectional view, taken substantially on line 10—10 of FIG. 9.
Figure 11:
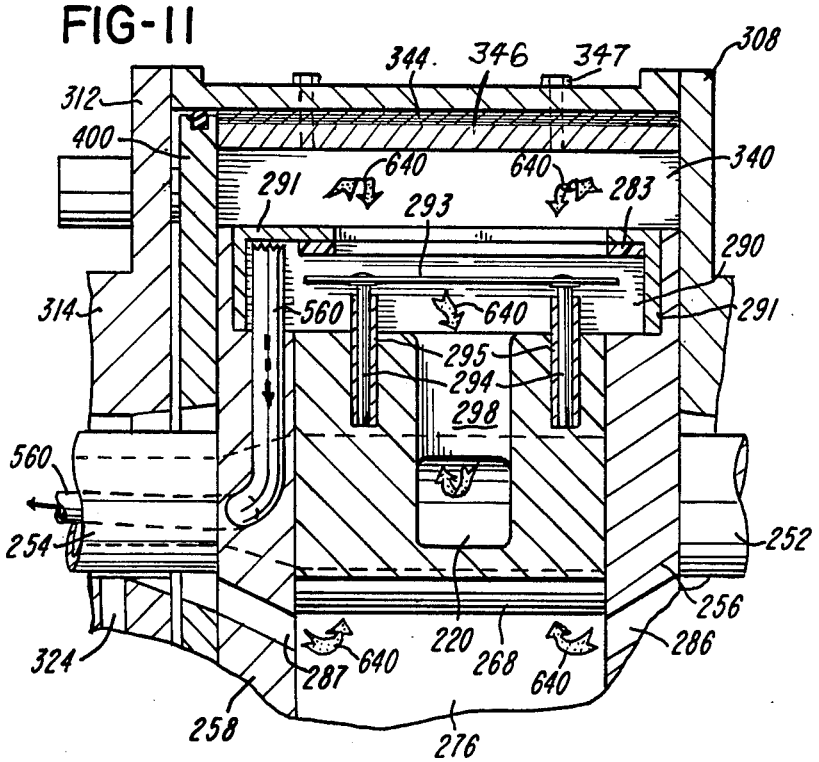
FIG. 11 is an enlarged fragmentary sectional view, taken substantially on line 11—11 of FIG. 10.

FIGS. 9, 10, and 11

FIGS. 9, 10, and 11 illustrate a modification of the rotary vane pump of this invention. The modification shown in FIGS. 9, 10, and 11 is particularly adapted for pumping a gaseous material. This modification includes means for introduction of a lubricant into the pump, for lubrication, for sealing, and for cooling of the pump. This modification also includes means for circulation of a lubricant through the pump.

In FIGS. 9, 10, and 11 a rotary vane pump of this invention comprises a main housing 200 which includes a base 220. The base 220 includes a pedestal 224 at one end thereof and a pedestal 228 at the other end thereof. The pedestal 228 supports a bearing housing 236 which supports a bearing 238. The pedestal 224 supports a bearing 244. The pedestal 224 also supports a bearing housing 239 which supports a bearing 240. The bearing housing 239 extends from the main housing 200. The pedestal 228 also supports a bearing 248. The bearings 238 and 240 are coaxial, and the bearings 244 and 248 are coaxial. However, the bearings 244 and 248 are not coaxial with the bearings 238 and 240. A shaft 252 extends through the bearing 238 and is rotatably supported thereby. The shaft 252 also extends through the pedestal 228. A hollow shaft 254 extends through the bearing 240 and is rotatably supported thereby. The hollow shaft 254 also extends through the pedestal 224.

Attached to the shaft 252 is a flange 256. Attached to the shaft 254 is a flange 258. The flanges 256 and 258 form walls of an inner rotor 260.

Between the flanges 256 and 258, and attached thereto, the inner rotor 260 has a shaft 268 provided with an axial passage 270. The passage 270 is in communication with the hollow shaft 254. The inner rotor 260 has a chamber 276 therein. A radially extending wall 280 attaches the shaft 268 to the outer portion of the inner rotor 260. The wall 280 extends substantially the axial length of the inner rotor 260. Within the wall 280 is a slot 284, which extends substantially the axial length of the inner rotor 260. Extending through the flange 256 is a plurality of passages 286. Extending through the flange 258 is a plurality of passages 287.

At the periphery of the inner rotor 260 is an elongate axially extending passage 288 which leads from the periphery of the inner rotor 260 to the chamber 276 therein.

The inner rotor 260 has an axially extending peripheral channel 290, within which is an elongate axially extending valve member 291 which is secured to the inner rotor 260 within the channel 290. The valve member 291 is provided with a valve seat 283. Mounted within the channel 290 is an elongate movable valve member 293, which has stems 294 attached thereto, as shown in FIG. 11. Sleeves 295 encompass the stems 294 and are attached to the inner rotor 260. The stems 294 are axially movable within the sleeves 295.

In communication with the channel 290 is a passage 298 which leads to the axially extending passage 270 within the inner rotor 260.

Encompassing the inner rotor 260 is an outer rotor 300. The outer rotor 300 has an end cover 308 at one end thereof which has an annular hub 310 integral therewith. The hub 310 is rotatably supported upon the bearing 248. At the other end of the outer rotor 300 is an end cover 312 provided with a hub 314. The hub 314 is rotatably supported upon the bearing 244. The hub 314 is provided with a plurality of passages 324 therethrough.

Attached to the inner surface of the outer rotor 300 is a vane 340 secured to the outer rotor 300 by means of a flexible angular leaf connection member 344 which is attached to the vane 340 and to the inner surface of the outer rotor 300. A block 346 and bolts 347 secure the flexible leaf connection member 344 to the outer rotor 300. The vane 340 extends into the slot 284 within the inner rotor 260, and the vane 340 is slidable within the slot 284 and with respect to the inner rotor 260.

The flexible leaf connection member 344 provides a good flexible connection of the vane 340 to the outer rotor 300. Also, the flexible leaf connection member 344 serves as excellent sealing means between the vane 340 and the outer rotor 300.

A sealing plate 400 within the outer rotor 300 engages the inner rotor 260. A plurality of stems 410 engage the sealing plate 400 and are positioned within recesses 416 in the end cover 312. Spring members 420 within the recesses 416 engage the stems 410 and urge the sealing plate 400 into engagement with the inner rotor 260.

As shown in FIG. 9, a conduit 444 is joined to the housing 200 for flow of gaseous material into the housing 200.

As shown in FIG. 9, the bearing housing 239 has a chamber 458. Within the chamber 458 to the left of the bearing 240, the hollow shaft 254 is provided with orifices 460.

Shown diagrammatically below the base 220 in FIG. 9 is a reservoir 500. Extending from the reservoir 500 to the bearing housing 236 is a conduit 510. The conduit 510 communicates with an annular passage 512, which communicates with passages 514 in the pedestal 228. At the end of each of the passages 514 is a spray nozzle 520.

Extending from the reservoir 500 to the bearing housing 239 is a conduit 530. The conduit 530 is in communication with an annular passage 538 which is within the bearing housing 239. The annular passage 538 is in communication with passages 544 which are within the pedestal 224. At the end of each of the passages 544 is a spray nozzle 550.

As shown in FIGS. 9 and 11, a tube 560 is positioned within the hollow shaft 254. The tube 560 extends within the flange 258 to a position adjacent the periphery of the inner rotor 260. Within the hollow shaft 254 the tube 560 is in communication with a conduit 566 which is supported by the bearing housing 239 and extends therefrom.

In communication with the conduit 566 is a conduit 570 which is joined to a pump 574. Extending from the pump 574 to the reservoir 500 is a conduit 580. Also, extending between the bearing housing 239 and the reservoir 500 is a conduit 586.

An exhaust conduit 590 is joined to the bearing housing 239 and is in communication with the chamber 458 which is within the bearing housing 239.

Operation

Preferably, drive means, not shown, are attached to the shaft 252 for rotation thereof. Rotation of the shaft 252 causes rotation of the inner rotor 260. Due to the fact that the vane 340 is attached to the outer rotor 300 and extends into the inner rotor 260, rotation of the inner rotor 260 causes rotation of the outer rotor 300. For purposes of description of the operation, the rotors 260 and 300 are shown rotating in a counter-clockwise direction, as illustrated by arrows 592 and 594 in FIG. 10.

Due to the fact that the inner rotor 260 and the outer rotor 300 do not rotate upon concentric axes, there is lateral movement between the outer rotor 300 and inner rotor 260 during rotation thereof. Thus, during rotation of the outer rotor 300 and the inner rotor 260 there is relative lateral movement between the vane 340 and inner rotor 260.

The apparatus of this invention as shown in FIGS. 9, 10, and 11 is adapted to pump a gaseous material, such as air or the like, into the housing 200. The gas flows into the housing 200 through the conduit 444 as illustrated by an arrow 600 in FIG. 9. The gaseous material flows within the housing 200, as illustrated by an arrow 610 in FIG. 9. The gaseous material flows into the passages 286 and 324, as illustrated by arrows 620 in FIG. 9.

As the gaseous material flows into the inner rotor 260, a lubricant flows to the bearing housings 236 and 239 from the reservoir 500 through the conduits 510 and 530, as illustrated by arrows 622 in FIG. 9. The lubricant is sprayed into the gaseous material from the spray nozzles 520 and 550 as illustrated in FIG. 9. The gaseous material with the lubricant, as a fluid, thus flows within the inner rotor 260 as illustrated by arrows 640 in FIG. 9. The fluid which comprises the gaseous material and the lubricant flows into the chamber or space between the inner rotor 260 and the outer rotor 300. The inner rotor 260 and the outer rotor 300, with the vane 340 thus cause the fluid to flow in the manner described with respect to the apparatus of FIGS. 1–8.

The portion of the fluid which contains a high proportion of lubricant tends to flow at the periphery of the inner rotor 260 and the outer rotor 300. The pump 574 draws the lubricant into the tube 560 and into the conduit 566 for flow of the lubricant to the reservoir 500 through the conduits 570 and 580. The mixture of gaseous material and lubricant also flows into the hollow shaft 254 as illustrated by an arrow 670 in FIG. 9. The mixture flows from the hollow shaft 254 through the orifices 460. A significant separation of the lubricant and the gaseous material occurs in the chamber 458 of the bearing housing 239. The gas flows outwardly from the chamber 458 through the conduit 590, as illustrated by an arrow 700 in FIG. 9. The lubricant which is separated from the gaseous material flows into the conduit 586 for return to the reservoir 500, as illustrated by an arrow 710 in FIG. 9.

Thus, the lubricant serves as a sealing means and as a coolant and as a lubricant within the inner rotor 260 and within the outer rotor 300. The lubricant flows from the reservoir 500 to the housing 200 and then returns to the reservoir 500. Thus, the lubricant circulates between the rotors 260 and 300 and the reservoir 500.

Thus, it is understood that the rotary vane pump of this invention is capable of significant volume of fluid flow in consideration of the physical dimensions of the pump.

The rotary vane pump of this invention is capable of operation with a combination of gas and lubricant. The pump of this invention is also capable of pumping a hydraulic fluid.

Although the preferred embodiment of the rotary vane pump of this invention has been described, it will be understood that within the purview of this invention various changes may be made in the form, details, proportion and arrangement of parts, the combination thereof, and the mode of operation, which generally stated consist in a rotary vane pump within the scope of the appended claims.

The invention having thus been described, the following is claimed:

1. A fluid pump comprising a base provided with a pair of spaced-apart pedestals, a pair of shafts rotatably supported by the pedestals, at least one of the shafts being a tubular shaft, the tubular shaft having an axial passage therethrough, an inner rotor attached to the shafts and supported thereby and rotatable therewith, the inner rotor having a cavity therein and being substantially hollow, the inner rotor having a peripheral surface, first conduit means within the inner rotor, the first conduit means forming a first passage which extends from the peripheral surface of the inner rotor to the axial passage through the tubular shaft, the inner rotor being provided with a second passage, the second passage providing communication between the cavity of the inner rotor and the peripheral surface of the inner rotor, the peripheral position of the first passage being spaced from the peripheral position of the second passage, an outer rotor rotatably encompassing the inner rotor and supported by the pedestals and rotatable about an axis which is eccentric with respect to the axis of rotation of the inner rotor, the inner rotor having a smaller diameter than the diameter of the outer rotor so that a chamber is formed between the inner rotor and the outer rotor, wall means within the inner rotor and extending substantially the length of the inner rotor, the wall means also extending radially from the peripheral surface of the inner rotor to a position adjacent the axis of rotation of the inner rotor, the wall means forming a slot which extends radially from the peripheral surface of the inner rotor to a position adjacent the axis of rotation of the inner rotor, the slot also extending axially substantially the length of the inner rotor, the peripheral position of the slot being between the peripheral position of the first passage and the peripheral position of the second passage of the inner rotor, the inner rotor being provided with a pair of opposed end portions, the outer rotor being provided with a pair of opposed end portions, the end portions of the inner rotor and the end portions of the outer rotor being provided with ports which communicate with the cavity within the inner rotor for flow of fluid from the exterior of the outer rotor into the cavity within the inner rotor, a vane within the outer rotor and secured to the outer rotor for movement therewith, the vane extending substantially the length of the inner rotor, the vane being slidably positioned within the slot of the inner rotor and being movable to and from a position adjacent the axis of rotation of the inner rotor, second conduit means for introduction of a liquid into the cavity of the inner rotor which communicates with the second passage, and third conduit means for conducting liquid from the cavity of the inner rotor which communicates with the first pasage, wherein fluid flows into the cavity of the inner rotor and then the fluid flows from the cavity of the inner rotor and into the outer rotor and then the fluid flows from the outer rotor to a position exterior of the outer rotor.

2. The fluid pump of claim 1 in which the third conduit means extends from a position adjacent the periphery of the inner rotor to a position within the tubular shaft.

3. The fluid pump of claim 1 which includes a sealing member within the outer rotor and axially movable into engagement with the inner rotor and resilient means urging movement of the sealing member toward the inner rotor.

4. The fluid pump of claim 1 which includes a housing encompassing the outer rotor, means for introduction of a gas into the housing, and means for introduction of a liquid into the housing.

5. The fluid pump of claim 1 which includes a main housing, a bearing housing extending from the main housing, a bearing within the bearing housing, the tubular shaft extending into the bearing housing and supported by the bearing, and an exhaust port joined to the bearing housing, the tubular shaft having a port in communication with the exhaust port.

6. The fluid pump of claim 1 which includes a main housing, an auxiliary housing attached to the main housing and extending therefrom, the tubular shaft extending into the auxiliary housing, the tubular shaft having a port within the auxiliary housing, the auxiliary housing having an exhaust port in communication with the port of the tubular shaft.

7. The fluid pump of claim 1 which includes a main housing, an auxiliary housing attached to the main housing and extending therefrom, the tubular shaft extending into the auxiliary housing, the tubular shaft having a port within the auxiliary housing, the auxiliary housing having an exhaust port in communication with the port of the tubular shaft, a tubular member having a portion within the tubular shaft, the tubular member also having a portion within the inner rotor, and fluid conduit means in communication with the tubular member and in communication with the auxiliary housing for transmission of fluid from the tubular member and from the auxiliary housing.

8. The fluid pump of claim 1 in which the pump is adapted to pump both a gas and a liquid, and in which the pump includes spray nozzle means for directing liquid into the inner rotor, and passage means for directing a gas into the inner rotor.

9. A fluid pump comprising:

an inner rotor, the inner rotor having a cavity therein and being substantially hollow, the inner rotor having a peripheral surface, first support means, the first support means rotatably supporting the inner rotor, the first support means including a hollow shaft which is attached to the inner rotor and which is rotatable with the inner rotor, the hollow shaft forming a flud conduit, the inner rotor being rotatable about the central axis of the hollow shaft, a substantially hollow outer rotor encompassing the inner rotor, second support means, the second support means encompassing the hollow shaft, the second support means being rotatably supported upon the first support means, means joining the second support means to the outer rotor, the second support means being positioned with respect to the first support means for rotation of the outer rotor about an axis eccentric with respect to the axis of rotation of the inner rotor, the inner rotor having a peripheral surface, conduit means within the cavity of the inner rotor and forming a first passage within the cavity of the inner rotor and extending between the peripheral surface of the inner rotor and the fluid conduit of the hollow shaft, valve means positioned within the first passage and permitting flow of fluid only in a direction from the peripheral surface of the inner rotor to the fluid conduit of the hollow shaft, means forming a second passage within the inner rotor, the second passage providing communication between a cavity of the inner rotor and the peripheral surface of the inner rotor, the inner rotor having a pair of opposed end portions, the outer rotor having a pair of opposed end portions, gas port means within the end portions of the inner rotor and the gas port means within the end portions of the outer rotor and adjacent the axes of rotation thereof for introduction of a gas into the inner rotor, liquid port means within the outer rotor and adjacent the inner rotor for introduction of liquid into the inner rotor through the gas port means of the inner rotor, radially extending guide means within the cavity of the inner rotor, a vane attached to the outer rotor and slidably positioned with the guide means of the inner rotor, the vane being secured to the outer rotor for movement with transverse movement with the outer rotor, the vane extending radially within the cavity of the inner rotor and having a portion movable to and from a position adjacent the axis of rotation of the inner rotor, the vane extending axially substantially between the end portions of the inner rotor, the inside dimension of the outer rotor being greater than the outside dimension of the inner rotor, wherein a chamber is formed between the inner rotor and outer rotor, and wherein the outer rotor and the inner rotor rotate together and wherein there is relative transverse movement between the inner rotor and the outer rotor during rotation thereof, wherein fluid flows into the cavity of the inner rotor through the port means, and wherein fluid flows from the cavity through the second passage and into the chamber between the inner rotor and the outer rotor, and wherein fluid is forced from the chamber into the first passage formed by the conduit means and into the fluid conduit of the hollow shaft as the rotors rotate and as reciprocal transverse movement between the inner rotor and the outer rotor occurs.

10. A fluid pump comprising: support means, an inner rotor, the inner rotor having a peripheral surface, the inner rotor also having a cavity therewithin and being substantially hollow, shaft means attached to the inner rotor for rotation therewith, the shaft means rotatably supporting the inner rotor upon the support means, the shaft means including fluid conduit means, an outer rotor encompassing the inner rotor, the outer rotor being substantially hollow and having an inside dimension considerably large than the outside dimension of the inner rotor, wherein a chamber is formed between the outer rotor and the inner rotor, bearing means rotatably supporting the outer rotor upon the shaft means for rotation of the outer rotor about an axis spaced from the axis of rotation of the inner rotor, the inner rotor having an exterior portion, the outer rotor having an exterior portion, fluid port means within the outer rotor and fluid port means within the inner rotor and positioned adjacent the shaft means, the fluid port means providing fluid communication between the exterior portion of the outer rotor and the cavity within the inner rotor for fluid flow from the exterior portion of the outer rotor to the cavity within the inner rotor, conduit means for conducting a gas to the fluid port means, conduit means for conducting a liquid to the fluid port means, conduit means for conducting a mixture of liquid and gas from the chamber and from the outer rotor, means forming a first passage within the inner rotor, the first passage extending from the cavity of the inner rotor to the exterior portion of the inner rotor for flow of fluid from the cavity of the inner rotor to the chamber between the outer rotor and the inner rotor, conduit means forming a second passage which extends within the inner rotor, the second passage extending between the exterior portion of the inner rotor and the fluid conduit means of the shaft means for flow of fluid from the chamber between the rotors to the fluid conduit means of the shaft means, wall means forming an axially and radially extending slot in the inner rotor, the wall means and the slot extending radially substantially between the periphery of the inner rotor and the axis of rotation thereof, the wall means and the slot extending substantially the axially length of the inner rotor, an axially extending vane within the outer rotor and secured thereto for movement therewith, the vane being positioned within the slot of the inner rotor, the vane extending substantially the axial length of the slot, the vane having a portion movable to and from a position adjacent the axis of rotation of the inner rotor, wherein fluid flows into the cavity of the inner rotor through the fluid port means of the rotors and fluid flows from the cavity through the first passage and into the chamber between the rotors, and wherein the inner rotor and the outer rotor rotate together about eccentric axes and force fluid from the chamber into the conduit means and through the second passage of the inner rotor into the fluid conduit means of the shaft means for flow of fluid from the fluid pump through the shaft means.

11. The fluid pump of claim 10 in which a tubular member extends between the periphery of the inner rotor and a position exterior of the outer rotor.

12. The fluid pump of claim 10 in which the fluid port means includes liquid spray means.

13. The fluid pump of claim 10 which includes a main housing which encompasses the outer rotor, and a bearing housing attached to the main housing, a portion of the shaft means being positioned within the bearing housing.

14. The fluid pump of claim 10 which includes a flexible connection member attached to the vane and to the outer rotor for attaching the vane to the outer rotor.

15. The fluid pump of claim 10 in which the shaft means has a hollow portion and in which a tubular member extends from the inner rotor to the hollow portion of the shaft means.

16. The fluid pump of claim 10 which includes a main housing which encompasses the outer rotor, which includes a bearing housing which is attached to the main housing, a portion of the shaft means being positioned within the bearing housing, the bearing housing having a chamber threrein, and conduit means for conducting fluid from the inner rotor to the chamber within the bearing housing.

17. The fluid pump of claim 10 which includes a housing which encloses the outer rotor, means for introducing a gas into the housing, and means for introducing a liquid into the housing.

18. The fluid pump of claim 10 which includes a main housing which encompasses the outer rotor, a bearing housing attached to the main housing, a portion of the shaft means being positioned within the bearing housing, a tubular member extending between the bearing housing and the inner rotor for conducting fluid from the inner rotor to the bearing housing, and conduit means for conducting fluid from the bearing housing.

19. A fluid pump comprising a base provided with a pair of spaced-apart pedestals, shaft means rotatably supported by the pedestals, at least a portion of the shaft means being a tubular portion, the tubular portion of the shaft means having an axial passage therethrough, an inner rotor attached to the shaft means and supported thereby and rotatable therewith, the inner rotor having a cavity therein and being substantially hollow, the inner rotor having a peripheral surface, conduit means within the inner rotor forming a first passage which extends from the peripheral surface of the inner rotor to the axial passage through the tubular portion of the shaft means, the inner rotor being provided with a second passage, the second passage providing communication between the cavity of the inner rotor and the peripheral surface of the inner rotor, the peripheral position of the first passage being spaced from the peripheral position of the second passage, an outer rotor rotatably encompassing the inner rotor and supported by the pedestals and rotatable about an axis which is eccentric with respect to the axis of rotation of the inner rotor, the inner rotor having a smaller diameter than the diameter of the outer rotor so that a chamber is formed between the inner rotor and the outer rotor, wall means within the inner rotor and extending substantially the length of the inner rotor, the wall means also extending radially from the peripheral surface of the inner rotor to a position adjacent the axis of rotation of the inner rotor, the wall means forming a slot which extends radially from the peripheral surface of the inner rotor to a position adjacent the axis of rotation of the inner rotor, the slot also extending axially substantially the length of the inner rotor, the peripheral position of the slot being between the peripheral position of the first passage and the peripheral position of the second passage of the inner rotor, the inner rotor being provided with a pair of opposed end portions, the outer rotor being provided with a pair of opposed end portions, at least one of the end portions of the inner rotor and at least one of the end portions of the outer rotor being provided with ports which communicate with the cavity within the inner rotor for flow of fluid from the exterior of the outer rotor into the cavity within the inner rotor, a vane within the outer rotor, flexible connection means attached to the outer rotor and to the vane for movement of the vane with movement of the outer rotor, the vane extending along the length of the inner rotor, the vane being slidably positioned within the slot of the inner rotor and being movable with transverse movement of the outer rotor to and from a position adjacent the axis of rotation of the inner rotor, the flexible connection means permitting angular movement of the vane with respect to the outer rotor during rotation of the inner rotor and the outer rotor, wherein during rotation of the rotors fluid flows into the cavity of the inner rotor and then fluid flows from the cavity of the inner rotor and into the outer rotor, and then fluid flows from the outer rotor.

20. The fluid pump of claim 19 in which the flexible connection means which is attached to the outer rotor and to the vane comprises a flexible leaf member having a portion attached to the outer rotor and a portion attached to the vane, the flexible leaf member attaching the vane to the outer rotor and sealing against flow of fluid between the outer rotor and the vane.

21. A fluid pump comprising a base provided with a pair of spaced-apart pedestals, shaft means rotatably supported by the pedestals, at least a portion of the shaft means being a tubular portion, the tubular portion of the shaft means having an axial passage therethrough, an inner rotor attached to the shaft means and supported thereby and rotatable therewith, the inner rotor having a cavity therein and being substantially hollow, the inner rotor having a peripheral surface, conduit means within the inner rotor forming a first passage which extends from the peripheral surface of the inner rotor to the axial passage through the tubular portion of the shaft means, the inner rotor being provided with a second passage, the second passage providing communication between the cavity of the inner rotor and the peripheral surface of the inner rotor, the peripheral position of the first passage being spaced from the peripheral position of the second passage, an outer rotor rotatably encompassing the inner rotor and supported by the pedestals and rotatable about an axis which is eccentric with respect to the axis of rotation of the inner rotor, the inner rotor having a smaller diameter than the diameter of the outer rotor so that a chamber is formed between the inner rotor and the outer rotor, wall means within the inner rotor and extending axially within the inner rotor, the wall means also extending radially from the peripheral surface of the inner rotor to a position adjacent the axis of rotation of the inner rotor, the wall means forming a slot which extends radially from the peripheral surface of the inner rotor to a position adjacent the axis of rotation of the inner rotor, the slot also extending axially within the inner rotor, the peripheral position of the slot being between the peripheral position of the first passage and the peripheral position of the second passage of the inner rotor, the inner rotor being provided with a pair of opposed end portions, the outer rotor being provided with a pair of opposed end portions, at least one of the end portions of the inner rotor and at least one of the end portions of the outer rotor being provided with ports which communicate with the cavity within the inner rotor for flow of fluid from the exterior of the outer rotor into the cavity within the inner rotor, a vane within the outer rotor, connection means attached to the outer rotor and to the vane for movement of the vane with movement of the outer rotor, the vane extending axially within the inner rotor, the vane being slidably positioned within the slot of the inner rotor and being movable with transverse movement of the outer rotor to and from a position adjacent the axis of rotation of the inner rotor, wherein fluid flows into the cavity of the inner rotor and then fluid flows from the cavity of the inner rotor and into the outer rotor, and then fluid flows from the outer rotor.

* * * * *

UNITED STATES PATENT AND TRADEMARK OFFICE

CERTIFICATE OF CORRECTION

PATENT NO. : 4,773,836

DATED : September 27, 1988

INVENTOR(S) : Jesse C. Moore

It is certified that error appears in the above-identified patent and that said Letters Patent are hereby corrected as shown below:

Column 2, line 50, delete the comma after "shaft".

Column 2, line 52, change "show" to ---shown---.

Column 3, line 58, insert a period after "thereof".

Column 10, line 44, change "large" to ---larger---.

Column 11, line 15, change "axially" to ---axial---.

Signed and Sealed this

Twenty-first Day of February, 1989

*Attest:*

DONALD J. QUIGG

*Attesting Officer*

*Commissioner of Patents and Trademarks*